United States Patent [19]

Yamac

[11] Patent Number: 4,524,263

[45] Date of Patent: Jun. 18, 1985

[54] ELECTRIC TRAVEL IRON USING PORTABLE HAIR-DRYER AS THE HEAT SOURCE

[75] Inventor: Yücel Yamac, Graz, Austria

[73] Assignee: Braun Aktiengesellschaft, Kronberg, Fed. Rep. of Germany

[21] Appl. No.: 451,151

[22] PCT Filed: Apr. 15, 1982

[86] PCT No.: PCT/DE82/00087

§ 371 Date: Nov. 30, 1982

§ 102(e) Date: Nov. 30, 1982

[87] PCT Pub. No.: WO82/03643

PCT Pub. Date: Oct. 28, 1982

[30] Foreign Application Priority Data

Apr. 18, 1981 [DE] Fed. Rep. of Germany ..... 3115696
Jan. 29, 1982 [DE] Fed. Rep. of Germany ..... 3202978

[51] Int. Cl.[3] ..... D06F 75/00; A45D 20/12; H05B 1/00

[52] U.S. Cl. ..... 219/249; 34/91; 34/243 R; 38/69; 38/82; 38/97; 126/411; 219/228; 219/258; 219/361; 219/368; 219/370; 219/373; 219/380; 219/474

[58] Field of Search ..... 219/200, 201, 228, 245–259, 219/361, 366–368, 370, 373, 379, 380, 472–475; 34/90, 91, 96–101, 243 R; 38/69, 71, 74, 82–85, 97, 77.1; 126/401, 411

[56] References Cited

U.S. PATENT DOCUMENTS

| | | | |
|---|---|---|---|
| 1,408,623 | 3/1922 | Manley | 126/401 |
| 1,603,117 | 10/1926 | Kimmel | 34/96 |
| 1,726,027 | 8/1929 | Johnson | 126/401 |
| 2,637,125 | 5/1953 | Roberts | 38/97 X |
| 3,109,083 | 10/1963 | Meltzer | 219/380 X |
| 3,258,578 | 6/1966 | Ferris | 219/373 X |
| 3,404,471 | 10/1968 | Wilsker et al. | 38/97 |
| 3,702,616 | 11/1972 | Mercer | 219/373 X |
| 3,860,174 | 1/1975 | Cercone | 219/373 X |

FOREIGN PATENT DOCUMENTS

| | | | |
|---|---|---|---|
| 1783735 | 2/1959 | Fed. Rep. of Germany . | |
| 7124188 | 9/1971 | Fed. Rep. of Germany . | |
| 2224780 | 12/1972 | Fed. Rep. of Germany . | |
| 2203469 | 8/1973 | Fed. Rep. of Germany . | |
| 2922396 | 12/1980 | Fed. Rep. of Germany . | |
| 36528 | 3/1930 | France | 38/77.1 |
| 1102164 | 5/1955 | France . | |
| 21008 | 6/1973 | Japan | 219/245 |
| 40218 | 11/1979 | Japan | 219/245 |
| 80207 | 7/1981 | Japan | 219/295 |
| 153306 | 11/1981 | Japan | 219/245 |
| 153307 | 11/1981 | Japan | 219/245 |
| 164988 | 1/1934 | Switzerland | 34/243 R |
| 848992 | 9/1960 | United Kingdom . | |

*Primary Examiner*—A. Bartis
*Attorney, Agent, or Firm*—Frishauf, Holtz, Goodman & Woodward

[57] ABSTRACT

An electric travel iron includes as an upper component a hand-held hot air type hair-dryer having a hand grip, an electric heating unit for heating a stream of air and an outlet duct having an open end through which a hot air stream is discharged. The lower component of the iron comprises a thin flat metallic ironing plate detachably connected to the air outlet duct of the dryer in spaced confronting relationship to the open end of the duct. The ironing plate is planar and has an upper side facing the open duct end to define a direct hot-air impingement surface region and extends laterally outwardly from the direct hot-air impingement region beyond the contour of the duct end for providing a region heated by hot air laterally deflected from the direct hot-air impingement region. The lower side of the ironing plate forms the ironing surface. A reflecting plate may be spaced above the ironing plate to provide a gap therebetween for guiding the deflected flow of hot air along the upper side of the ironing plate towards the edges thereof. The ironing plate may be provided holes in the hot air impingement region for passage of air therethrough into contact with the article being ironed. A manually actuated spray device may be provided on the iron for moistening the material being ironed.

23 Claims, 9 Drawing Figures

ELECTRIC TRAVEL IRON USING PORTABLE HAIR-DRYER AS THE HEAT SOURCE

Figure 1:
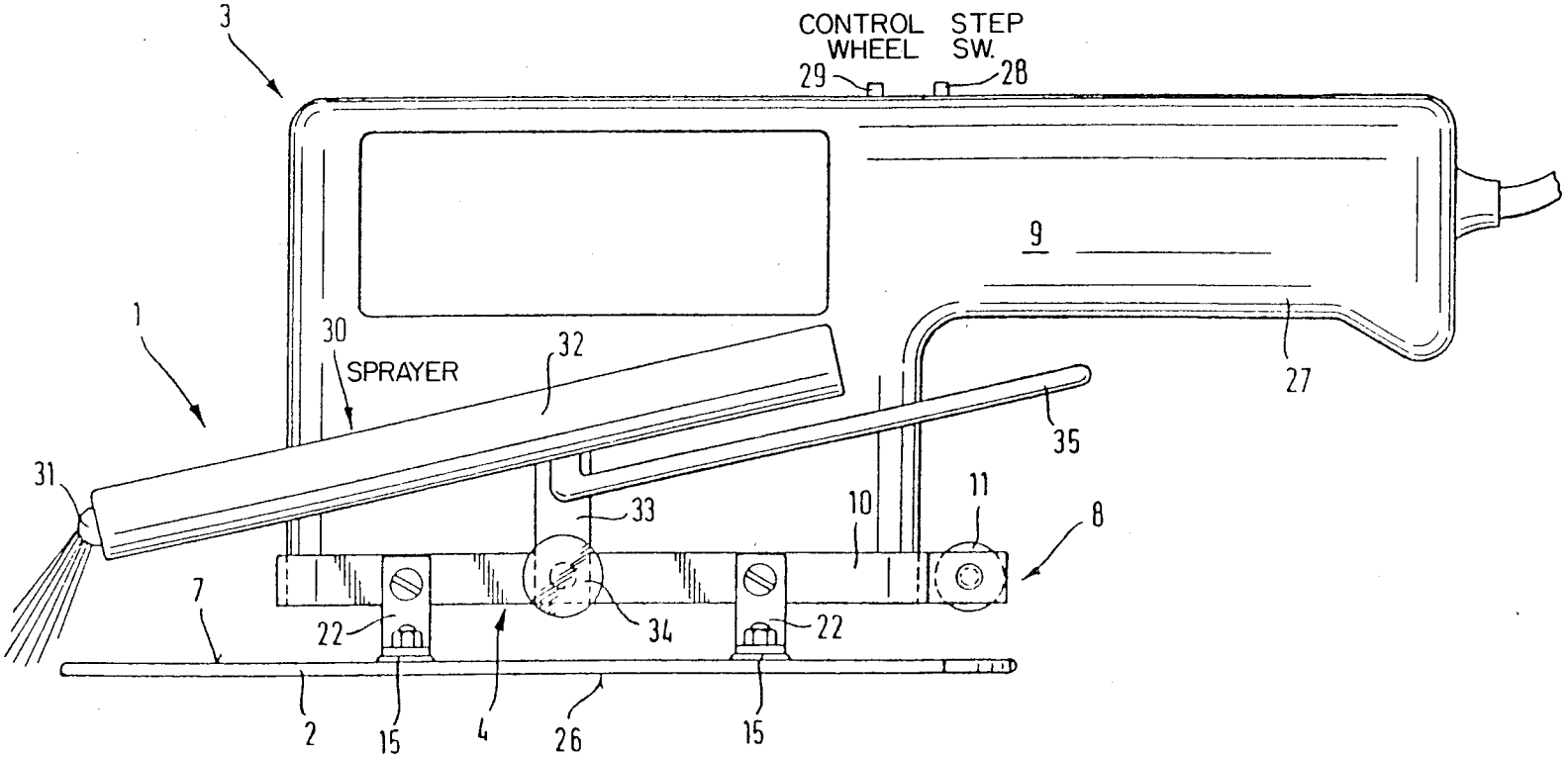

The invention concerns an electric iron, particularly a travel iron, with an ironing plate, an upper part that may in some cases have a hand-grip and a heating part.

Electric irons of this kind are known. They have a massive, heavy bottom plate of metal in or upon the upper side of which heating coils, or the like, are electrically insulated and mounted beneath a protective cover. Above the protective cover, which is usually affixed to the bottom plate, there is as a rule an upper part for the iron usually affixed to the protective cover and equipped with a handle. The underside of the bottom plate, which ordinarily is mostly smooth, is heated for ironing by the electrical heating spiral or the like.

Such irons have some disadvantages, however, for particular kinds of application. In particular they are too heavy for taking along on a trip and also too cumbersome. In order to avoid this inconvenience, so-called travel irons have already been produced for a long time. These represent essentially only embodiments on a smaller scale of the same irons described above. They have practically the same expensive production and are still relatively heavy and cumbersome.

It is accordingly an object of this invention to provide an iron which will above all be easy to transport and to store, avoiding to a great extent the disadvantages mentioned above, and will also be relatively cheap to produce.

Briefly, by this invention an electric iron of the kind already mentioned is provided in which the upper part and the heating part are constituted by an electric hair-dryer or the like, in front of the hot-air nozzle of which there is arranged an ironing plate which allows the heat generated by the hair-dryer to pass through it.

In such an appliance, the hot air delivered by the hair-dryer is drawn upon for ironing, and the ironing plate which in practice is provided as an accessory for the hair-dryer can be made unusually light. The complete iron, including the hair-dryer, can, if desired, weigh noticeably less than a comparable travel iron, but still, at the same time, it can additionally be used as a hair-dryer. It has also been found that in the case of such an iron, for the reason, among others, that hot air is provided for heat transfer, there is no burning of the article to be pressed or an ironing board, or the like, located below, even if this iron is not turned off, e.g. while it remains standing on the article to be pressed.

A particularly advantageous embodiment of the iron is provided when its ironing plate has apertures or the like, more or less in the region of the hot air stream of the hair-dryer. The hot air can thereby directly reach the article being pressed within the region of the ironing plate, so that to a certain extent hot air and ironing plate simultaneously affect the article being pressed.

In order to reduce heat radiation from the ironing plate, it is useful to dispose a reflection plate between the hot-air nozzle and the ironing plate having an aperture lying opposite the hot-air nozzle, by which the hot-air stream is guided through a gap along the upper-side of the ironing plate. The reflection plate thus produces an improvement of the flow conditions, with a heating film between the reflection plate and the ironing plate. An increased heat pick-up by the ironing plate results and thereby also a higher ironing temperature, which leads to a shortening of the ironing time. The opening in the reflection plate can have essentially the same shape as the hot-air nozzle of the hair-dryer and be a flat aluminum plate of which the underside is mirror-bright, in order to reflect back to the ironing plate the heat radiated upwards therefrom. In contrast, the upper side reflection plate can be lacquered dark.

In order to keep the heat transfer between the ironing plate and the reflection plate at low values, heat-insulating spacers can be provided between the reflection plate and the ironing plate. Special flow relations are produced if, in the case of another embodiment, the reflection plate is domed in such a way that the height of the gap is reduced toward the edge of the reflection plate.

Additional further developments of the invention are provided below in the description and in the features of the subsidiary claims.

The invention is more closely described below by way of three illustrative examples with their details essential to the invention, by reference to the drawing.

Figure 2:
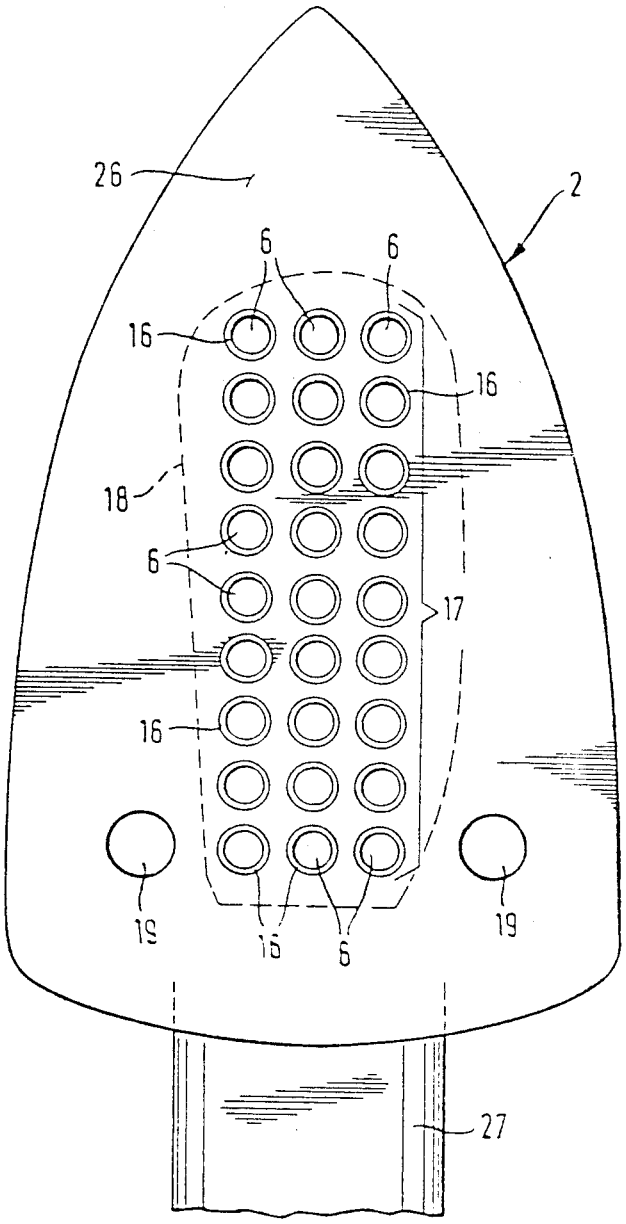
Figure 3:
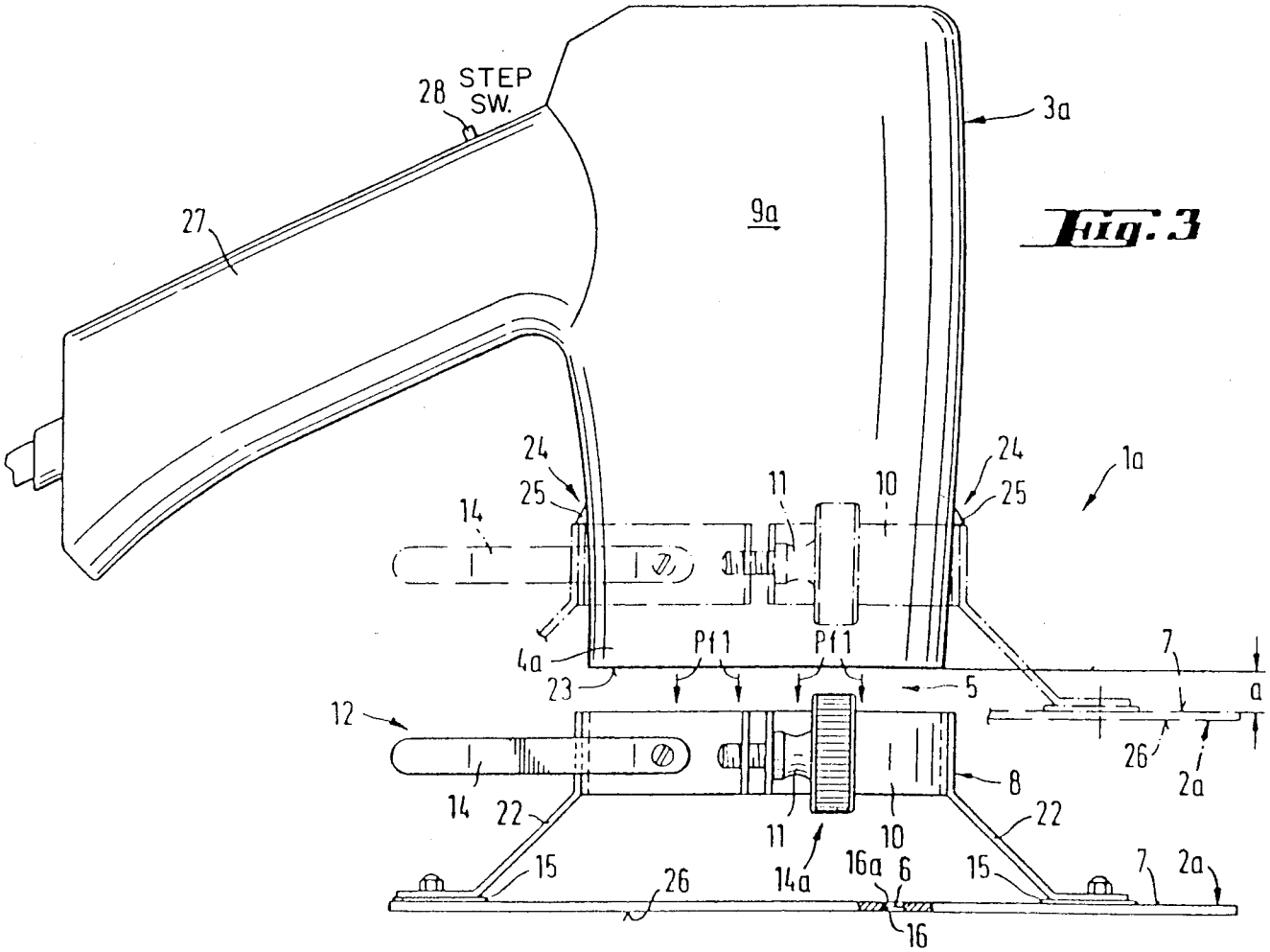
Figure 4:
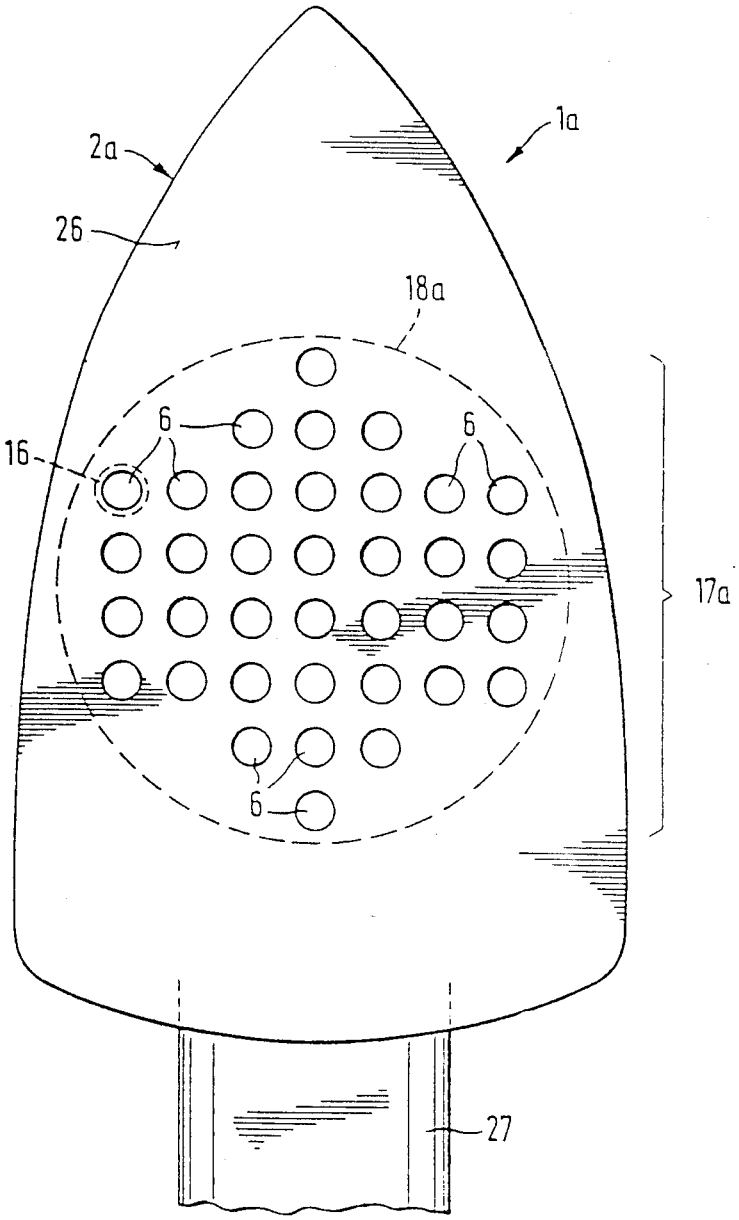
Figure 5:
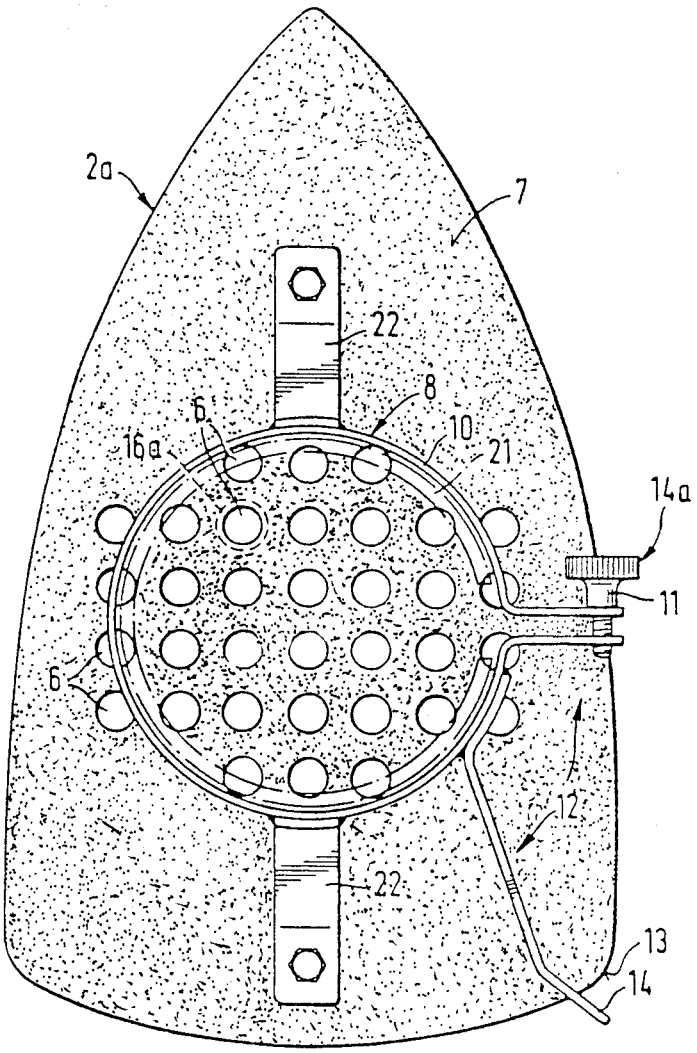
Figure 6:
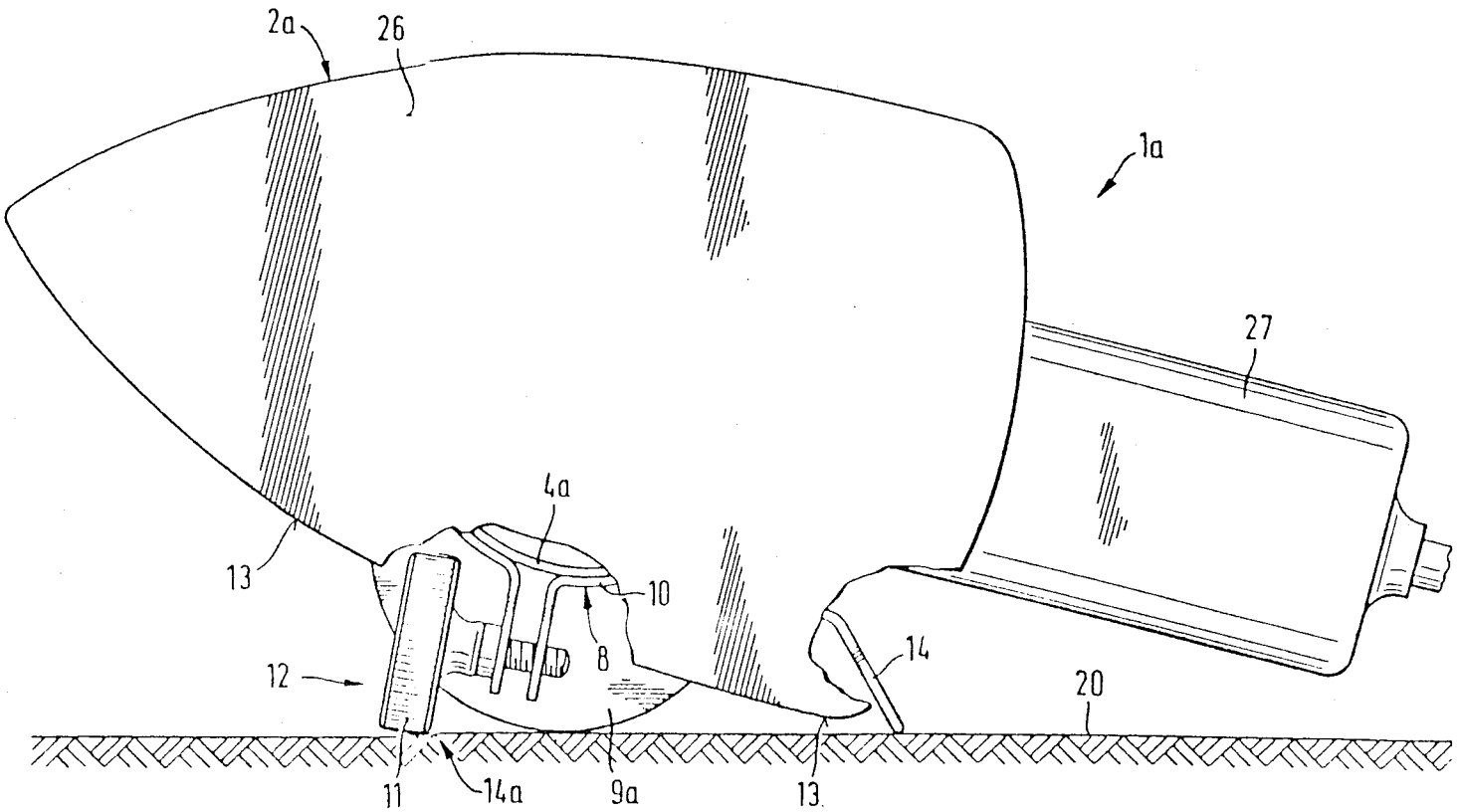
Figure 7:
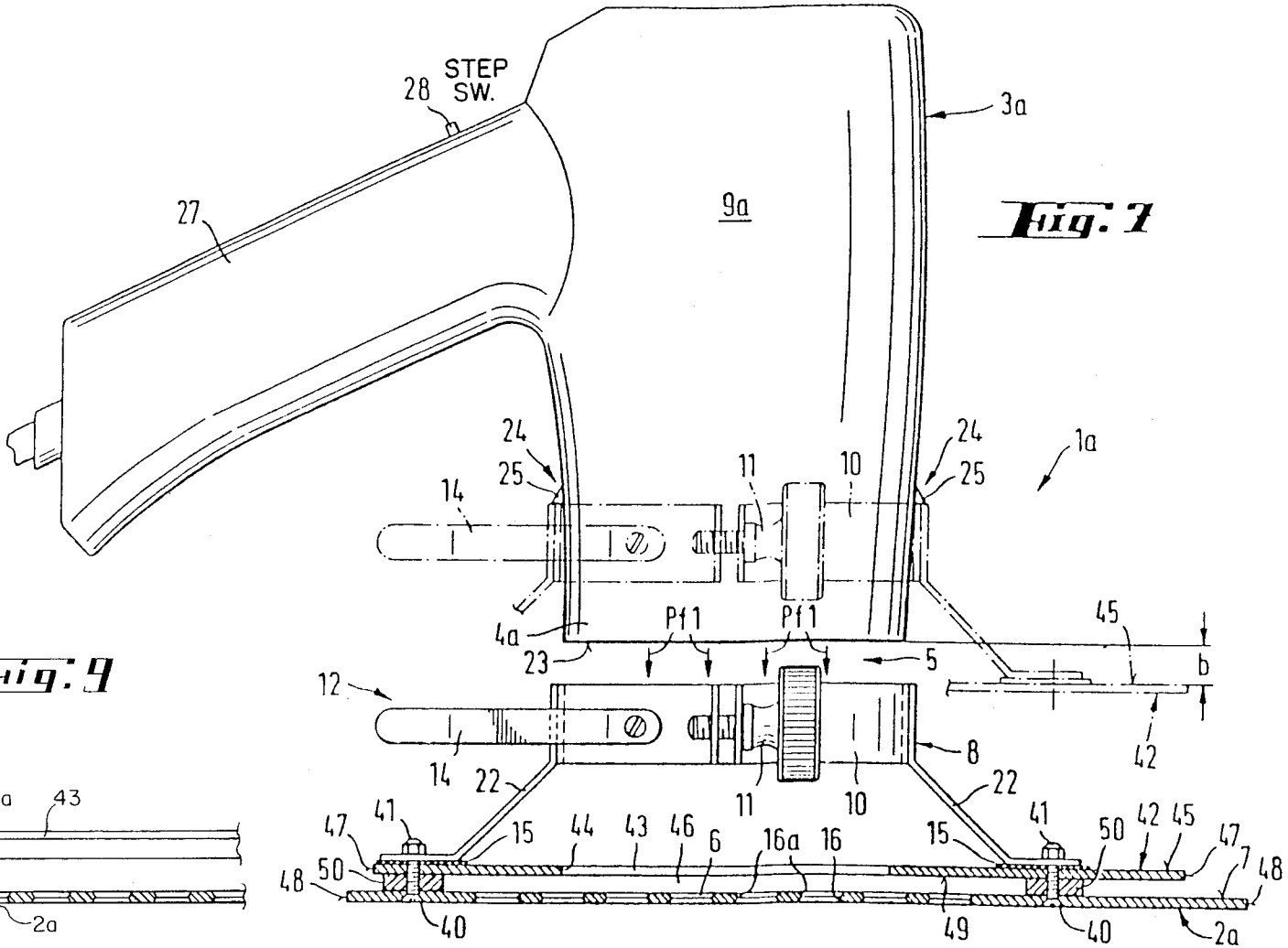
Figure 9:
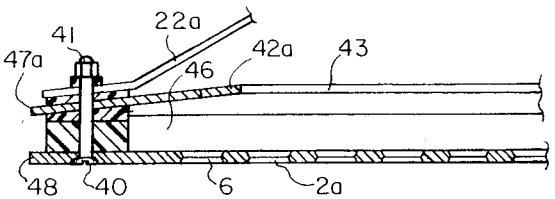
Figure 8:
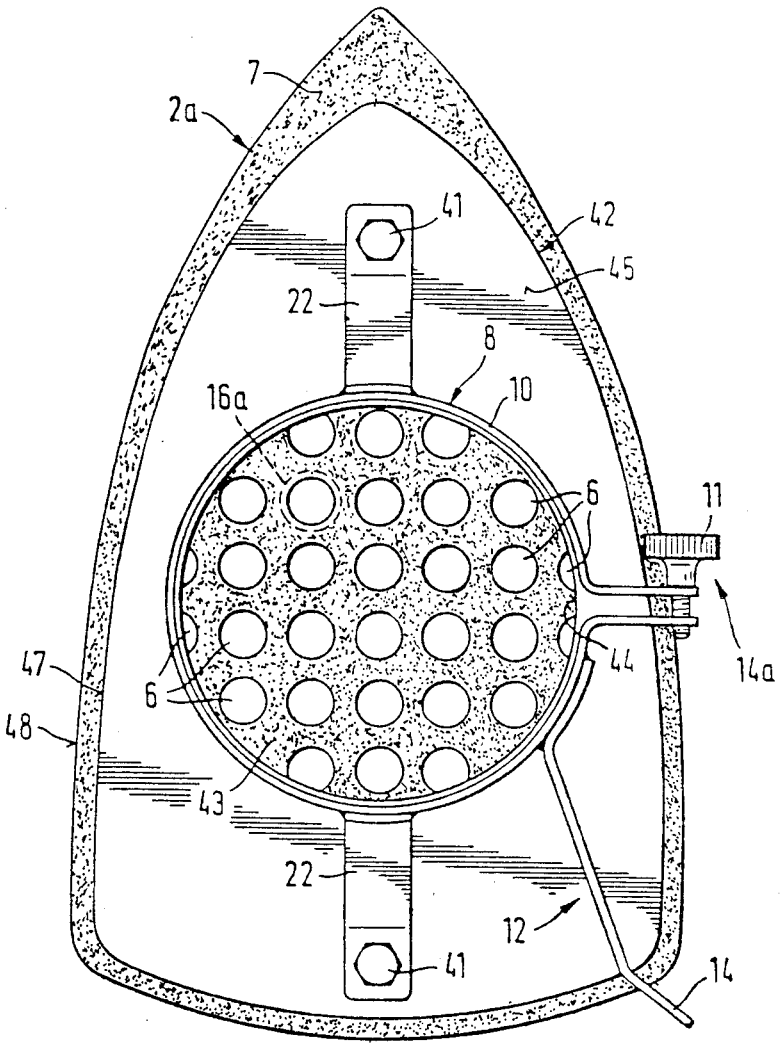

FIG. 1 shows a side view of a first embodiment of the invention,

FIG. 2 shows a bottom view of the ironing plate of the iron according to FIG. 1, FIG. 3 shows an exploded view of a somewhat modified illustrative embodiment of an iron, FIG. 4 shows a bottom view of the ironing plate of the iron according to FIG. 3, FIG. 5 shows a top view of the upper side of the ironing plate show in FIG. 4, and showing the connection device attached thereto, FIG. 6 shows a perspective side view of an iron in rest position, FIG. 7 shows a side view of a further illustrative embodiment of the invention with a reflection plate;

FIG. 8 shows a top view of the upper side of the ironing plate of an iron according to FIG. 7 in a representation corresponding to FIG. 5, and FIG. 9 is a partial diagrammatic cross section of a further embodiment of the invention having a domed reflection plate.

An electric iron (FIGS. 1 and 2), in its entirety designated as 1, has a thin ironing plate 2 of aluminum as well as an electric hair-dryer designated in its entirety as 3. Out of the hot-air duct and orifice 4 of the hair-dryer of hot-air stream 5 designated with arrows Pf1 in FIG. 3 proceeds in the usual way and impinges upon the upper-side 7 of the ironing plate 2. On the latter a connection structure, designated 8 as a whole, is provided by means of which the ironing plate 2 can be connected in a simple way with the housing 9 of the hair-dryer 3. For this purpose, the connection structure 8 preferably has a clamp bracket 10 equipped with a clamp screw 11. The connection structure makes possible a simple assembly of the ironing plate 2 and the hair-dryer 3 as well as an easy separation of these parts 2,3, so that by means of the ironing plate 2, to some extent constituted as an attachment, a hair-dryer can easily be converted into an iron and can thus be additionally made useful.

In FIGS. 3 to 5, an illustrative embodiment somewhat modified in comparison in FIGS. 1 and 2 is shown having a hair-dryer 3*a* of another type and an ironing plate 2*a* made suitable for this type. As is particularly well recognizable from FIGS. 2 and 4, the ironing plates 2,2*a* have holes 6 or similar air passages in the region of the hot-air stream 5 impinging on the plate. The outline shape of the aperture field 17,17*a* of the respective ironing plates 2 and 2*a* is in each of these cases fitted to the contours 18 and 18*a* of the respective duct ends 4 and 4a. For example, the duct ends 4 of the hair-dryer 3 according to FIG. 1 has a substantially rectangular contour 18 which is indicated in broken lines in FIG. 2. Corresponding to it, the aperture field 17 there located is also provided with a substantially rectangular enclosing shape. On the other hand, the duct end 4a in the case of the hair-dryer according to FIG. 4 has a circular contour 18a and the aperture field 17a (FIG. 4) of the corresponding ironing plate (2a) conforms thereto.

In order to increase the number of passages, supplementary apertures 19 (FIG. 2) can be provided also outside of the aperture fields 17 and 17a of the corresponding ironing plates 2 and 2a. Instead of the holes 6, slots or other passages arranged in the region of the aperture 17,17a can be provided.

The heat produced by the hair-dryer 3,3a is supplied not only through these holes 6 or the like to the article to be pressed, but the hot-air stream 5 also heats the entire ironing plate 2,2a. The plate is therefore thin and fabricated of a material that conducts heat well, preferably of aluminum. By "thin" in the sense of this application, there will be understood, in the case of an ironing plate 2,2a which is provided with holes 6 or the like, a plate of a thickness from about 1.5 mm up to about 3 mm, preferably a plate of about 2 mm thickness. If desired, an especially thin ironing plate or one especially thinned down in the region of impingement of the hot-air stream can be used. Its region that is free of holes would then for example have a thickness of less than 1.5 mm, so that even without holes 6 or the like a rapid heat penetration would be possible; the embodiment with the holes 6 or the like described further above, however, represents a preferred form of embodiment. The structure of the upperside 7 of the ironing plate 2,2a is so constituted that it can pick up heat well and does not unnecessarily reflect it. For this purpose, it is made rough and dull. This effect can also be produced, for example with a suitable pigment. On account of the heating effect, however, a corresponding rough, dull structure has been found particularly advantageous.

In FIGS. 3, 5 and 6, a tipped-position stand for the iron 1a, designated as a whole by 12, is easily recognizable. It is so disposed that the ironing plate 2a does not touch an ironing board 20 or similar underpinning or the article to be ironed (not shown) lying thereon, when the iron 1a is placed in the tipped-over side position according to FIG. 6. An operator can therefore conveniently lay down the iron 1a, e.g. even without shutting it off. A corresponding arrangement is of course also possible for other embodiments of the iron, e.g. for the iron 1 according to FIGS. 1 and 2. In that case the support legs 14 and 14a are so disposed that they project laterally for a corresponding piece beyond the adjacent side edges 13 of the ironing plate 2a. A very simply producible and effective tipped-position stand is obtained if at the clamping bracket 10 a freely extending strip is constituted as one stand leg 14, while in a convenient manner the clamp screw 11 likewise extends out far enough beyond the side edge 13 of the ironing plate 2a that it forms the second stand leg 14a. As is clearly evident likewise from FIG. 5 in connection with FIG. 3, the clamp strip 10 or other connection element is defined to fit the corresponding contour or the casing 9a of the hair dryer. A tube-like intermediate piece 21 is also provided which is insertable in the clamp strip 10 or the like and shown in section in chain-dotted lines. The tube-like insert 21 is made elastic in the radial direction, e.g. with at least one through-going axial slot at the edge and produced from an elastic material such as synthetic plastic for example. It serves for fitting the connection structure 8 to the hair-dryer casing 9a which is of a different contour. This intermediate piece can also serve for insulation between the connection structure 8 and the hair-dryer casing 9a. Independently thereof, heat-insulation means are provided already on the connection path between the ironing plate 2,2a on the one hand and the casing 9,9a usually made of plastic, of the hair-dryer 3. Preferably these consist of insulating disks 15 which are made, e.g. of asbestos or heat-resistant plastic and are applied at the lower end of the connection structure 8 at the place of connection to the ironing plate 2, 2a (FIGS. 1 and 3).

As already mentioned, the ironing plate 2,2a preferably consists of a material such as aluminum which is light and at the same time has good heat conductivity. As a matter of practicality the essential parts of the connection structure 8, as for example the clamp strip 10 and the supports 22 leading therefrom to the ironing plate 2,2a, are made of a light material such as aluminum. There it is not a question of heat conductivity, but the light weight, as well as the great suitability for fabrication are nevertheless advantageous there.

As is especially easily recognizable from FIG. 3, a spacing a is provided between the duct-end orifice 23 of the hair-dryer 3a on the one hand, and the upperside 7 of the ironing plate 2a, which spacing is usefully from about 4 to 6 mm, preferably about 5 mm. It can, if desired, also be made somewhat greater. It has however been found that with such a minimum spacing of about 5 mm, the hair-dryer 3a will not become too hot by the accumulation of heat above the ironing plate 2a. For this reason it is also harmless to have a somewhat greater spacing between the ironing plate 2a and the nozzle orifice 23. In order to obtain this optimum spacing a of about 5 mm without difficulty in assembly of the iron 1a, the assembly-aid 24 is provided. This consists, in the embodiment of FIG. 3, of stop tangs 25 for the clamp strip 10 which are provided on the housing 9a of the hair-dryer 3a.

As can readily be recognized from FIG. 3, the holes 6 are broadened towards the underside 26 of the ironing plate 2a. They there have a conical flare 16. Furthermore, these holes are also widened towards the upperside 7 of the ironing plate, preferably likewise by a conical flare 16a (FIG. 3). The flares 16,16a are indicated in FIGS. 4 and 5 only by broken lines at each hole 6.

The surface of the article to be ironed on which the hot-air stream 5 impinges is thereby increased and the entrance of the hot-air stream 5 into the holes 6 is particularly favored by the conical flares 16a of the ironing plate top side. Finally, the underside 26 of the ironing plate 2,2a is flat, e.g. polished, and is constituted at its side edges and likewise especially at the edges of the holes, with smooth rounded-off transitions. Trouble-free ironing is thereby favored. An electric switch 28 can be seen on the handle 27 of the hair-dryer 3a (FIG. 3). It serves for switching the hair-dryer 3a on and off and is at the same time constituted as a step switch, however. In a hair-dryer according to FIG. 1, there are provided such a switch 28 and also a control wheel 29 that makes possible a fine control within the range of the step switch. These switching and control possibilities, usually already provided in hair-dryer 3 and 3a, are made available by the invention for use as an iron without requiring additional expense.

There is also shown, in a somewhat schematic way, in FIG. 1, a spraying device designated 30 as a whole. This device has a nozzle opening 31 at the front end of the iron and a hollow cylinder 32 used as a container for water. It is affixed to the iron 1 by means of a mounting strap 33, preferably fastened on the connection structure 8 of the ironing plate 2, by means of a knurled screen. The spray device 30 also has an operating lever 35 that preferably projects into the region of the handle 27 of the hair-dryer 3. Accordingly, it is simple to actuate the hand lever 35 of the spray device 30 when needed in ironing, so that the article to be ironed will be lightly moistened directly before ironing.

The ironing plate 2,2*a*, including its connection structure 8 designed as an accessory for hair-dryer 3,3*a*, is uncomplicated, readily manufactured, has small space requirement and is extremely light in comparison to ordinary irons and even in comparison to travel irons. They can be produced to have a weight of about 50 grams and can be made in a form fitting to any of a wide variety of hair-dryers already available. The iron 1,1*a* of the present invention is therefore particularly well-suited for travelers and vacationers as well as for ordinary use by persons having limited storage space available. It is particularly well-suited for air travel. Since the ironing plate 2,2*a* is readily removable from the remainder of the appliance, namely the hair-dryer 3,3*a*, the parts 2,2*a* and 3,3*a* of the iron are easy to stack and store separately. It is furthermore important that in all likelihood no danger of fire can be incurred by the iron 1, even when it is unintentionally allowed to stand for a long time on the article to be ironed with the heating element turned on. Furthermore, the iron 1,1*a* is further protected against overheating by the temperature-limiting safety switch that is normally provided in the hair-dryer 3,3*a*. Experiments have shown that the heating of the article to be ironed is sufficient for pressing flat while, all the same, there is no risk of fire. Even the danger to the operator of contact burns is practically excluded.

It is desirable to perform ironing with the iron 1,1*a* more slowly, compared with ironing with conventional irons, pushing the iron forward in the desired direction of ironing over the article to be ironed without substantial back-and-forth movement. In the embodiment of the iron 1,1*a* having an ironing plate 2,2*a* provided with holes 6, a hot-air film is formed in the middle region below the ironing plate 2,2*a*, while at the same time the heated ironing plate has the usual effect on the article being ironed. If desired, however, an imperforate plate 2*a* can be used, as illustrated in FIG. 6.

Investigation has shown that the hot-air stream 5 has still more advantageous additonal effects in the use of the irons 1 and 1*a*. Suction is produced around the housing 9,9*a* by which cold air continually flows from above for cooling the hair-dryer. The hot-air stream 5, which proceeds above the ironing plate 2,2*a* and flows away laterally essentially in all directions, also has an effect of smoothing the article to be ironed in the immediate vicinity of the ironing plate 2,2*a*. Ironing is thereby simplified because wrinkling of the article being ironed can be, under some circumstances, avoided entirely on account of the deflected hot-air stream 5. The deflected hot-air stream also blows away undesired dust particles, ashes and the like, so that they are not unintentionally ironed into the work.

A further illustrative embodiment of the invention is shown in FIGS. 7 and 8. The iron 1*a* consists, again, of a hair-dryer 3*a* which is connected by a connecting structure 8 to an ironing plate 2*a*, but in this case there is additionally disposed a reflection plate 42 above the ironing plate 2*a*, in order to obtain a higher ironing temperature.

At its lower end shown in FIG. 7, the hair-dryer 3*a* is equipped with a hot-air nozzle 4*a* out of which a hot-air stream 5 escapes, as shown by the arrows Pf1 when the hair-dryer is switched on. The hot-air stream 5 passes through an opening in the reflection plate 42 into a gap 46 between the reflection plate 42 and the ironing plate 2*a*. The hot-air stream proceeding downwards is thereby deflected by an angle of 90° causing a flow of hot air proceeding from the middle to the edge 47 of the reflection plate 42, and likewise proceeding to the edge 48 of the ironing plate 2*a*.

The hot-air stream 5 moving outwards in the gap 46 produces a heating film that leads to an increased heat accumulation in the ironing plate 2*a* and thereby a shortening of the ironing time. The heat radiated upwards from the ironing plate 2*a* is reflected back by the reflection plate 42, the geometry of which is shown in FIG. 8. The heat losses are thereby reduced, so that the ironing plate 2*a* reaches a temperature which is increased compared to the case of an arrangement in which there is no reflection plate.

As is best seen in FIG. 8, the reflection plate has a contour that corresponds essentially to that of the ironing plate 2*a*, but with the edge 47 of the reflection plate 42 lying somewhat drawn back to the interior compared to the edge 48 of the ironing plate 2*a*. The opening 43 for letting in the warm air-stream 5 is circular, defined by the circular edge 44, FIG. 8 showing an embodiment having a hair-dryer equipped with a circular hot-air duct-end 4*a*.

While the upper side 7 of the ironing plate 2*a* is constituted so that it can absorb heat well and reflect as little heat as possible, the underside 49 of the reflection plate 42 on the contrary, is plain or polished and so made that the reflection plate 42 picks up as little hea as possible and reflects as well as possible the heat radiated from the upper side 7 of the ironing plate 2*a*. The upper side 45 of the reflection plate 42 is lacquered dark, for example dark blue. The material of the reflection plate 42 is preferably aluminum.

As can be seen in FIGS. 7 and 8, the ironing plate 2*a* equipped with the reflection plate 42, as in some previous examples, has a multiplicity of holes 2 in its mid-region, through which the hot-air 5 can get into contact with the article being ironed during ironing. The edges of the holes 6 have a conical flare 16,16*a*, which is indicated in FIG. 8 merely for one of the holes 6.

The spacing between the aluminum reflection plate 42 having a thickness of, for example, 0.5 mm, and the aluminum ironing plate 2*a*, which is about 2 mm thick, amounts to a few millimeters and is fixed by spacers 50 made of a heat-insulating material, for example polytetrafluoroethylene (PTFE) or asbestos. The spacers 50 have central holes through which counter-sunk flathead screws 40 pass, which hold the ironing plate 2*a* and the reflection plate 42 together and connect the combined structures to the legs 22 of the connecting structure 8. Heat-insulating washers 15, as already pointed out above, are inserted between the upper side 45 of the reflection plate 42 and the legs 22. Nuts 41 on the upper end of the counter sunk screws 40 are tightened to hold the above-described pieces together.

The heat-insulated legs 22 are permanently affixed, as in the other illustrative embodiments, to a clamping structure 10 of the connection structure 8. The hair-dryer 3*a* is clamped at its end containing the hot-air outlet duct 4*a* in the clamping strip 10 by means of the clamping screw 11. The duct orifice 23 is thus located at a spacing of a few millimeters from the upper side 45 of the reflection plate 42, this spacing being, by way of example, 3 mm. By this spacing, designated b on the drawing, heat transfer from the ironing plate 2*a* and the reflection plate 42 over to the nozzle orifice 23 of the plastic housing 9 of the hairdryer 3*a* is substantially reduced.

In order to facilitate the adjustment of the spacing for the user, an assembly-assisting feature 24 is again provided in this case, consisting essentially of the stop tangs 25 which come into abutment with the clamping strip 10 when the hair-dryer is in the proper position. In order to make it easier to lay the iron down, a stand member 14 is provided on the clamping strip 10 as in the embodiment shown in FIGS. 3 and 5, so that the iron 1*a* can be laid down on its side without the ironing plate 2*a* coming into contact with the surface on which the iron rests. Here again, the clamping screw 11 cooperates with the stand member 14 to constitute the necessary stand 12.

In the case of another embodiment substantially shown FIG. 9, the reflection plate 42*a* is not flat, but is upwardly domed, so that the gap 46*a* becomes narrower towards the edge 47*a* of the reflection plate. With the bent reflection plate, it is possible to obtain a further increase of temperature.

I claim:

1. Electric iron, comprising:

a hand-held hot air type hair-dryer constituting an upper component of said iron, said dryer having a hand grip, providing its heating unit as a heat source for said iron, and having an outlet duct for discharge of a hot air stream from an open end of said duct;

an ironing plate;

means (8) for connecting said ironing plate to said hot air outlet duct and holding said ironing plate facing said open end of said duct and spaced therefrom, thereby presenting a direct hot-air impingement surface region of said ironing plate lying directly in front of said open duct end for impingement of hot air thereagainst, said ironing plate, (2,2*a*) having a plane upper side (7) facing said open duct end (4, 4*a*) and extending laterally outward from said direct hot-air impingement surface region and hence beyond the contour (18, 18*a*) of said open duct end (4, 4*a*) for providing a rim region capable of being heated by hot air laterally deflected from said direct hot-air impingement surface region, and a reflection plate (42) interposed between said open duct end (4*a*) and said ironing plate (2*a*) and having an aperture (43) opposite said open duct end for passage of hot air therethrough for exit through a gap (46) between said reflection plate and said ironing plate (2*a*) after impingement upon said direct hot-air impingement region, said gap guiding said hot air along said upper side (7) of said ironing plate.

2. Iron according to claim 1, in which said aperture (43) of said reflection plate (42) has a shape substantially conforming to said contour (18*a*) of said open duct end (4*a*) of said hair-dryer (3*a*).

3. Iron according to claim 1, in which said ironing plate (2,2*a*) is provided with holes (6) for passage of air in said direct hot-air impingement surface region of said ironing plate.

4. Iron according to claim 3, in which at least a preponderant number of said holes of said ironing plate are located in a group (17, 17*a*) shaped corresponding to said contour (18, 18*a*) of said duct (4, 4*a*).

5. Iron according to claim 3, in which the underside (26) is said ironing plate (2, 2*a*) is smooth and is provided with rounded-off edges at its periphery and at the rims of said holes.

6. Iron according to claim 1, in which said ironing plate (2, 2*a*) is a thin plate of a material having good conductivity for heat.

7. Iron according to claim 1, in which said means (8) for connecting said ironing plate to said duct and holding said ironing plate facing the end of said duct, is attached to said ironing plate and includes a clamping member (10) fitting around the exterior of said end of said duct and means (11) for tightening said clamping member.

8. Iron according to claim 7, in which assembly aid features (24) in the form of stoptangs for positioning said clamping member (10) are provided on said outlet duct of said hair-dryer.

9. Iron according to claim 7, in which heat-insulating spacers (50) are interposed between said reflection plate (42) and said ironing plate (2*a*).

10. Iron plate according to claim 9, in which said connecting means includes support strips (22) holding said reflection plate (42) with respect to clamping member (10) of said connecting means and thereby indirectly holding said ironing plate (2*a*) spaced from said reflecting plate (42), heat insulating washers (15) being interposed between the upper side (45) of said reflection plate (42) and said support strips (22) of said connecting means for impeding transfer of heat to said hair dryer from said ironing plate (2*a*) through said support member (22).

11. Iron according to claim 1, in which said ironing plate and said connecting means are constituted of a lightweight material.

12. Iron according to claim 11, in which said lightweight material is aluminum.

13. Iron according to claim 1, in which the spacing between said open end (23) of said duct and said upper side (7) of said ironing plate (2, 2*a*) is at least 3.6 mm.

14. Iron according to claim 1, comprising also, on said upper component constituted by said hair-dryer, a step-switch (28) and a control wheel (29) for controlling said hair-dryer when it is assembled together with said ironing plate to form an iron.

15. Iron according to claim 1, comprising also a spray device (30) for moistening the material being ironed, attached to said ironing plate (2).

16. Iron according to claim 1, comprising also a spray device (30) for moistening the material being ironed, attached to said connecting means (8), said connecting means being affixed to said ironing plate.

17. Iron according to claim 1, comprising a spray device (30) for moistening the material being ironed attached, to said ironing plate and having an actuating lever (35) extending into the neighborhood of said hand grip.

18. Iron according to claim 1, in which said reflector plate (42) is a plane aluminum plate, having a mirror surface on its under side (49).

19. Iron according to claim 1, in which said reflection plate (42) is concave on its side facing said ironing plate, so that the distance across said gap (46) diminishes towards the edge (47) of said reflection plate (42).

20. Electric iron, comprising:

a hand-held hot air type hair-dryer constituting an upper component of said iron, said dryer having a hand grip, providing its heating unit as a heat source for said iron, and having an outlet duct for discharge of a hot air steam from an open end of said duct;

an ironing plate, and means (8) for connecting said ironing plate to said hot air outlet duct and holding said ironing plate facing said open end of said duct and spaced therefrom, thereby presenting direct hot-air impingement surface region of said ironing plate lying directly in front of said open duct end for impingement of hot air thereagainst, said ironing plate (2, 2*a*) being a thin plate of material having good conductivity for heat and having a plane upper side (7) facing said open duct end (4, 4*a*) and extending laterally outward from said direct hot-air impingement surface region and hence beyond the contour (18, 18*a*) of said open duct end (4, 4*a*) for providing a rim region capable of being heated by hot air laterally deflected from said direct hot-air impingement surface region, said upper side (7) of said ironing plate (2, 2*a*) being constituted so as to be able to pick up heat and having a matte surface character.

21. Electric iron comprising:

a hand-held hot air type hair-dryer constituting an upper component of said iron, said dryer having a hand grip, providing its heating unit as a heat source for said iron, and having an outlet duct for discharge of a hot air stream from an open end of said duct;

an ironing plate, and means (8) attached to said ironing plate and including a clamping member (10) and means (11) for tightening said clamping member, for connecting said ironing plate to said hot air outlet duct and holding said ironing plate facing said open end of said duct and spaced therefrom, thereby presenting a direct hot-air impingement surface region of said ironing plate lying directly in front of said open duct end for impingement of hot air thereagainst, said clamping member fitting around the exterior of said end of said duct, said connecting means (8) further including an intermediate piece (21) inserted in said clamping member (10) for fitting said connecting means (8) to the duct end (4, 4*a*) of a hair-dryer having a duct end of a size smaller than is the case for said hair-dryer duct end which said clamping member fits around directly;

said gripping plate (2, 2*a*) having a plane upper side (7) facing said open duct end (4, 4*a*) and extending laterally outward from said direct hot-air impingement surface region a hence beyond the contour (18, 18*a*) of said open duct end (4, 4*a*) for providing a rim region capable of being heated by hot air laterally deflected from said direct hot-air impingement surface region.

22. Electric iron comprising:

a hand-held hot air type hair-dryer constituting an upper component of said iron, said dryer having a hand grip, providing its heating unit as a heat source for said iron, and having an outlet duct for discharge of a hot air stream from an open end of said duct;

an ironing plate;

means (8) attached to said ironing plate and including a clamping member (10) and means (11) for tightening said clamping member, for connecting said ironing plate to said hot air outlet duct and holding said ironing plate facing said open end of said duct and spaced therefrom, thereby presenting a direct hot-air impingement surface region of said ironing plate lying dirctly in front of said open duct end for impingement of hot air thereagainst, said clamping member fitting around the exterior of said end of said duct, said ironing plate (2,2*a*) having a plane upper side (7) facing said open duct end (4, 4*a*) and extending laterally outward from said direct hot-air impingement surface region and hence beyond the contour (18, 18*a*) of said open duct end (4, 4*a*) for providing a rim region capable of being heated by hot air laterally deflected from said direct hot-air impingement surface region, and a leg (14) projecting beyond the side edge (13) of said ironing plate (2, 2*a*) said clamping member (10) of said connecting means (8) being constituted so as to provide a second support leg (14*a*).

23. Electric iron comprising:

a hand-held hot air type hair-dryer constituting an upper component of said iron, said dyer having a hand grip, providing its heating unit as a heat source for said iron, and having an outlet duct for discharge of a hot air stream from an open end of said duct;

an ironing plate, and means (8) for connecting said ironing plate to said hot air outlet duct and holding said ironing plate facing said open end of said duct and spaced therefrom, thereby presenting a direct hot-air impingement surface region of said ironing plate lying directly in front of said open duct end for impingement of hot air thereagainst, said ironing plate, (2, 2*a*) having a plane upper side (7) facing said open duct end (4, 4*a*) and extending laterally outward from said direct hot-air impingement surface region and hence beyond the contour (18, 18*a*) of said open duct end (4, 4*a*) for providing a rim region capable of being heated by hot air laterally deflected from said direct hot-air impingement surface region, heat insulating material (15) being interposed between said connecting means (8) and said ironing plate (2, 2*a*) for heat insulation of said ironing plate with respect to said hair-dryer.

* * * * *